United States Patent [19]

Simmons

[11] 3,960,158

[45] June 1, 1976

[54] HAIR WEAVING TENSION SYSTEM

[76] Inventor: Pansy Simmons, 328 Huey P. Long Ave., Gretna, La. 70053

[22] Filed: May 24, 1974

[21] Appl. No.: 472,457

[52] U.S. Cl. ..... 132/56
[51] Int. Cl.[2] ..... A41G 3/00
[58] Field of Search ..... 132/5, 56, 53; 112/229, 112/410, 140

[56] References Cited

UNITED STATES PATENTS

| | | | |
|---|---|---|---|
| 2,621,663 | 12/1952 | Jenkins | 132/5 |
| 2,690,722 | 10/1954 | McCreery | 112/140 |
| 2,695,621 | 11/1954 | Cox | 132/56 |
| 3,225,724 | 12/1965 | Klassert | 112/410 |
| 3,381,642 | 5/1968 | Bono | 112/229 |

*Primary Examiner*—G. E. McNeill
*Attorney, Agent, or Firm*—Pugh & Keaty

[57] ABSTRACT

A hair weaving tension system utilizing a thread supply tension device (note FIG. 1) comprising a vertical support pole having three spools of thread separately housed within three tension members which resist and control and thereby tension the thread as it is pulled by the operator for use in weaving bands of hair on the head of a person as a hair styling technique (note FIG. 4). The resistance or tension on each thread is produced by a cylindrical housing having a thread opening therein and a mating, cylindrically surfaced bearing member which bears against the housing and thereby against the thread coming through the thread opening (note FIGS. 2 and 3). The frictional drag on the thread can be varied by a set screw whose position can be used to vary the force that the bearing member applies against the housing. With the threads under the tension and control of the thread supply device to produce an even flow of thread, the three threads are used by the beauty operator to weave bands of hair on a person's head (note FIGS. 5–7).

9 Claims, 7 Drawing Figures

1
2
3
4
5
6
7
8
10
11
12
12'
12"
13
13'
13"
14
14'
14"
15
15'
16
17
18
19
19'
20
30
101
102
103

HAIR WEAVING TENSION SYSTEM

BACKGROUND OF THE INVENTION

The present invention relates to a hair weaving tension system for use in hair styling by an operator to produce woven bands of hair on a person's head, including a certain thread supply tension device and a certain method of use.

Hair weaving as a hair styling or beauty technique has been known for a long period of time. Prior art patents which show what appear to be hair woven hair styles are U.S. Pat. Nos. 4,031 (1870), 136,720 (1873), 170,497 (1875) and 220,627 (1879). Hair weaving is also at the present time enjoying a renewed interest and is in relatively great demand.

However, heretofore, hair weaving has been a very expensive beauty treatment, requiring a highly skilled beauty operator a relatively long period of time. One particular problem has been in the supply of the threads during weaving which usually was in the form of loosely supported thread spools. Such loosely supported thread spools resulted in many a mishap in use and has been very inefficient and difficult to work with, substantially adding to the burden of the beauty operator when attempting to weave bands of hair using the prior art standard techniques.

In contrast to the prior art, the present invention utilizes a thread supply tension device which allows the thread to be supplied under equal tension when pulled by the operator, producing an even flow of the material. In the preferred embodiment of the present invention tension is applied to each thread by frictional drag in a very simple, straight forward and reliable mechanical structure which likewise serves as a housing for the spool of thread.

As a result, the present invention overcomes or substantially diminishes the above-referred to problems of the prior art. Thus the present invention allows a lesser degree of skill on the part of the beauty operator and greatly reduces the time of and burden on the beauty operator, and hence achieves greatly reduced costs on the part of the consumer.

Moreover, all of these desirable results are achieved by a structure which is relatively inexpensive to manufacture and relatively maintenance free.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DESCRIPTION OF THE PREFERRED EMBODIMENT

Introduction

Figures 1, 2, 3:
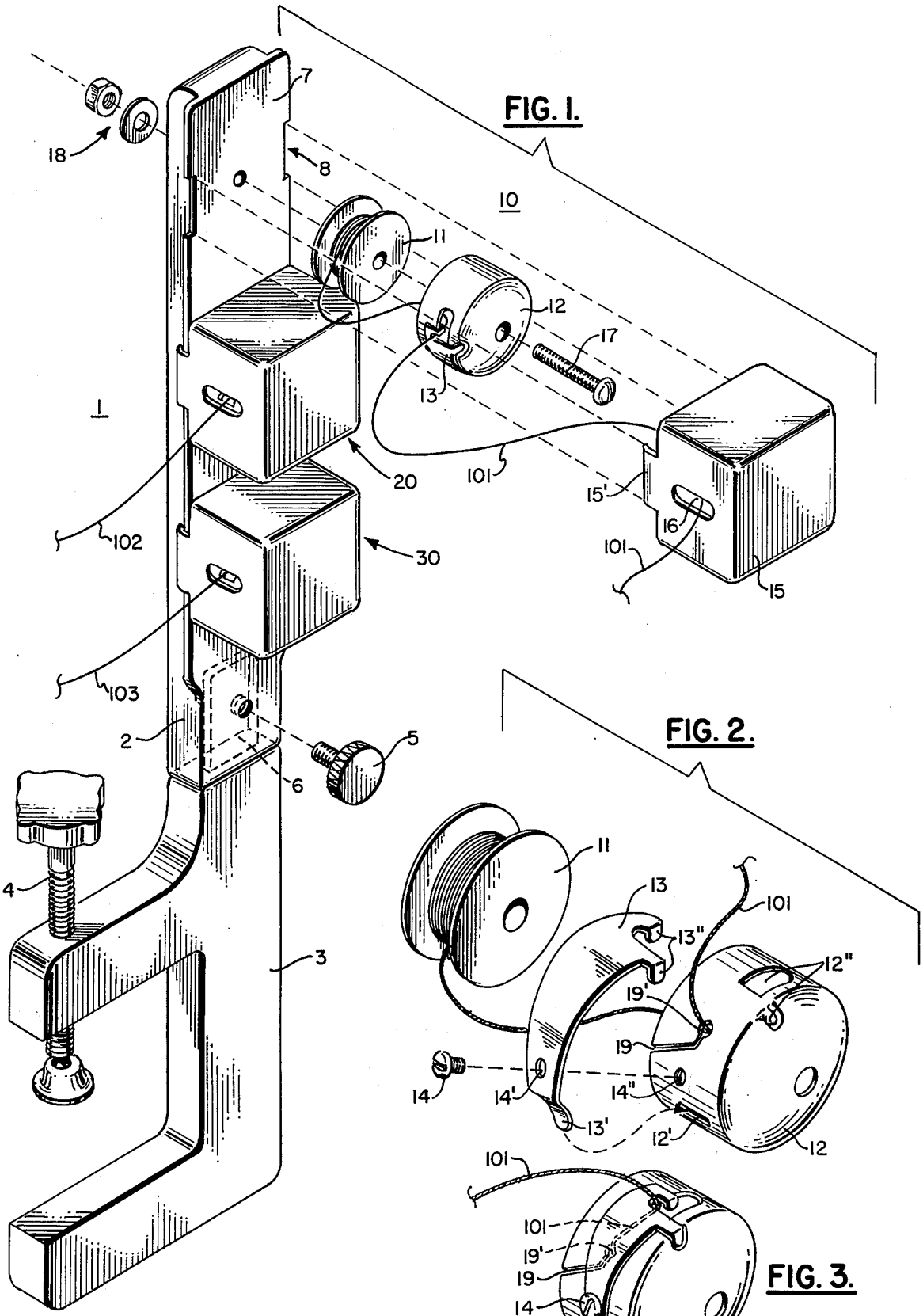
FIG. 1 is a perspective view of the preferred embodiment of the thread supply tension device of the present invention, with one of its thread supply elements shown in exploded array.
FIGS. 2 and 3 are perspective views of the three piece tension member of the present invention and the standard thread spool, the former in exploded array and the latter in assembled form.
Figure 4:
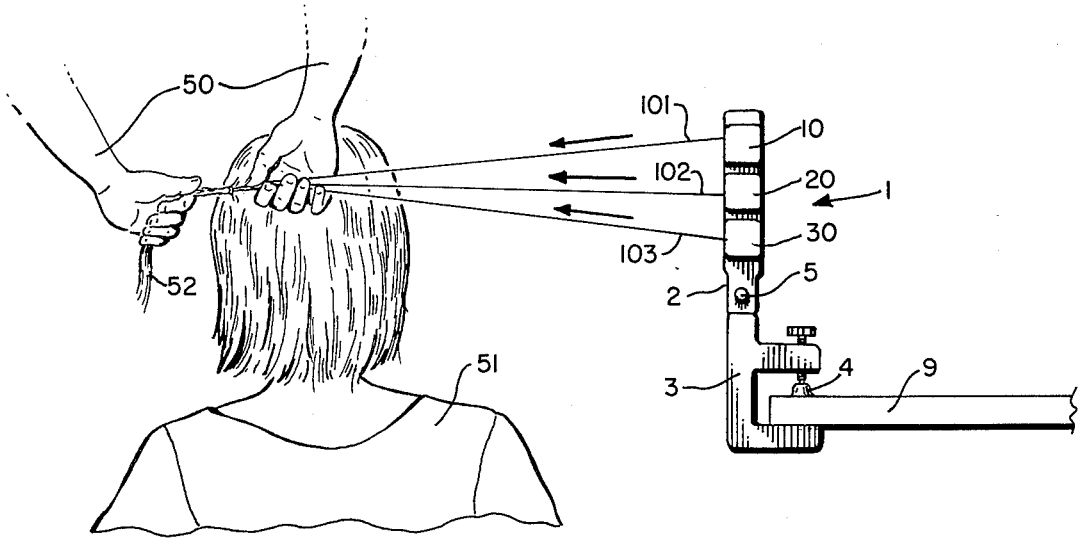
FIG. 4 is a back view showing the operator applying the threads to a shank of hair on a person's head, with the threads being supplied from the thread supply tension device of the present invention.
Figure 5:
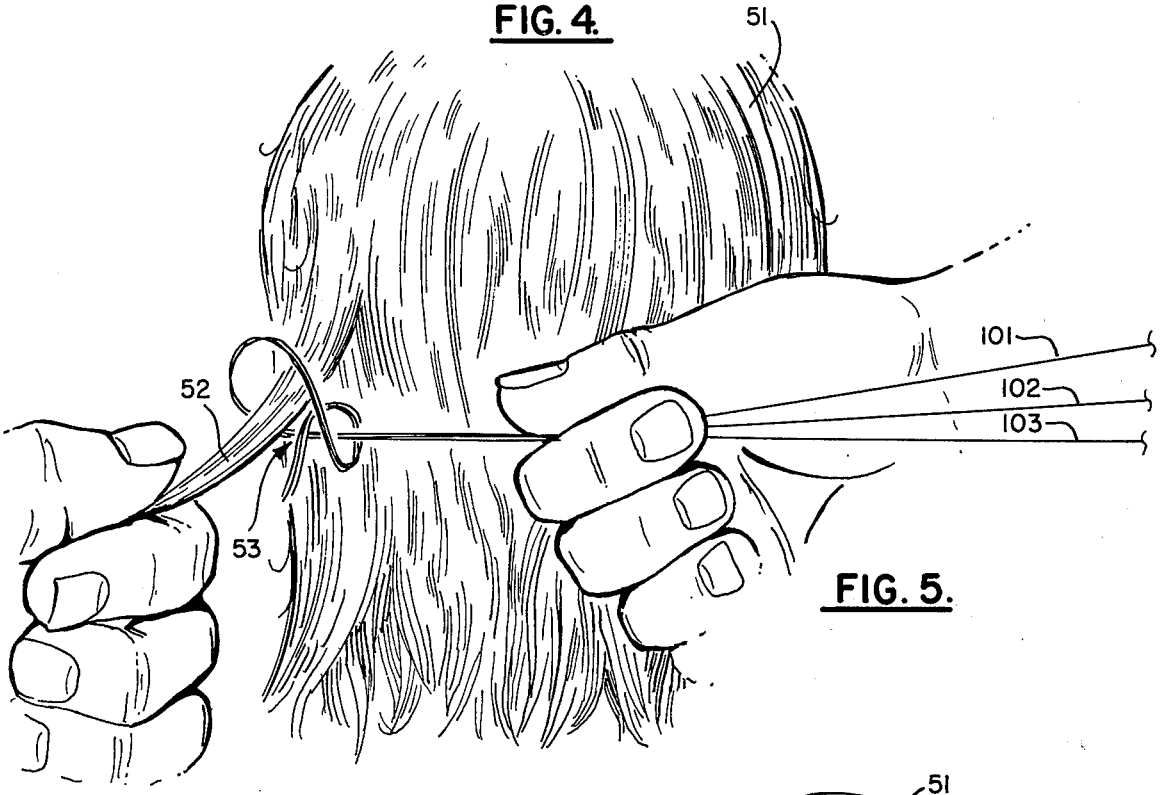
FIG. 5 is a close-up, back view showing the operator applying the initial knot to the base of a shank of hair to start the hair weaving process.

The present invention is directed to a hair weaving tension system utilizing a thread supply tension device, the preferred embodiment of which is structurally illustrated in FIGS. 1–3 while the method of application or use of the tension system is illustrated in FIGS. 4–7.

Structure of Thread Supply Tension Device

As best shown in FIG. 1, the preferred embodiment of the thread supply tension device 1 comprises an upper support post or section 2 and a lower attaching or clamping section 3. The post 2 carries three thread supply and tension members 10, 20 and 30 which supply three threads 101, 102, and 103 under tension to an operator for an even, controlled flow of the threads.

The upper and lower sections 2, 3 are connected to each other by a tongue 6 and slot connection and locked together by means of locking screw 5. The lower section 3 is in the form of a C clamp having a locking set screw 4 for attaching the device 1 to a convenient working surface 9 (note FIG. 4) such as for example a table. The orientation of the upper section 2 relative to the lower section 3 can be easily changed by unloosening screw 5, removing the upper section 2, rotating it 180° and refastening screw 5. Thus the direction of thread egress relative to the supporting surface 9 can be easily changed as desired.

Each thread supply and tension member, such as for example member 10, includes the standard thread spool 11 within a cylindrical tension applying housing 12 having a mating, cylindrically surfaced bearing member 13 thereon whose bearing force is varied by set screw 14. The assembly 11–14 is attached to the post 2 by means of bolt 17 and nut and washer 18. The assembly 11–14 is then covered by means of an outer housing 15 having a thread slot 16 therein. The outer housing 15 has resilient tabs 15′ which mate with slots 8 on the upper section 2 and hold the housing 15 against the face 7 of the post 2.

With further reference to FIGS. 2 and 3, the tension or drag resistance on the thread 101 is applied by means of the cylindrical housing 12 in cooperation with the resilient or springing bearing member 13. The bearing member 13 is attached to the housing 12 by means of the screw 14 and a lower tongue 13′ which fits into slot 12′ of the housing 12. The screw 14 extends through the hole 14′ and mates with the threaded femal orifice 14″. The bearing member 13 through its cylindrical shape mates with and resiliently bears in face-to-face engagement against the outer cylindrical surface of the housing 12 with a bearing force determined by the position of the screw 14.

The housing 12 includes a thread slot 19 terminating in a thread hole 19′ near the center of the area of engagement between the housing 12 and the bearing member 13. The upper end of the bearing member 13 includes a cul-de-sac and two, positioning dog ears 13″ which mate with an indented portion and an opening 12'' in the housing 12.

The spool of thread 11 is placed within the housing 12, and the thread 101 slid through the slot 19 to the thread hole 19' and led across the mating engagement area between the housing 12 and the bearing member 13 and across the cul-de-sac. With the thread 101 so located, the bearing force of the bearing member 13 on the housing 12 as determined by the set of the screw 14 is also applied to the thread 101 and a frictional drag placed on it. This produces a resistance tension on the thread when it is pulled by the operator during use, providing a controlled, even flow of thread during use.

Hair Weaving Method

With reference to FIGS. 4–7, the preferred method of hair weaving of the present invention, utilizing the thread supply tension device 1, is illustrated with an operator 50 and a subject 51.

Figure 6:
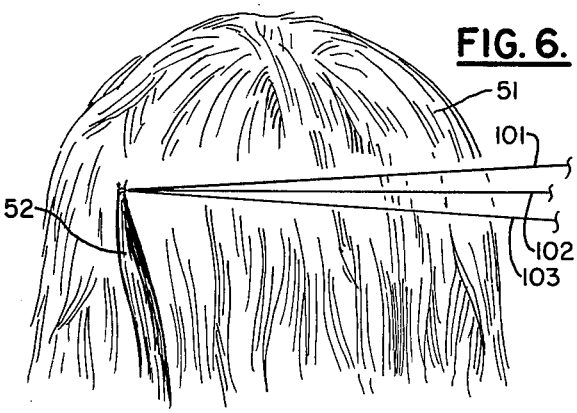
FIGS. 6 and 7 are back views of the person's head having the hair weaving beauty treatment being applied, the former figure show the initial start and the latter showing an interim condition as a woven band has been partially formed by the weaving together of several shanks of hair.

To begin the hair weaving (best illustrated in FIGS. 4 and 5) the operator 50 takes in her left hand a shank of hair 52, for example 15 hairs, and the three threads 101–103 from the thread supply tension device 1 are encircled around the base of the shank 52 of hair. A double half-hitch knot 53 (note FIG. 5) is then formed and tightened, and the three threads 101–103 are thereby tied to the base of the shank 52 of hair. As shown in FIG. 6, this is the beginning of the band of hair which is to be woven in accordance with the present invention. The shank 52 with the thread ends knotted thereto is then held in the left hand and the right hand sequentially placed under each thread 101–103 and the hair shank 52 and the threads 101–103 woven together in the well-known standard way to produce an interwoven braid. The sequential weaving of the hair shank 52 and threads 101–103 is repeated twice for a total of six inter-weaves.

Figure 7:
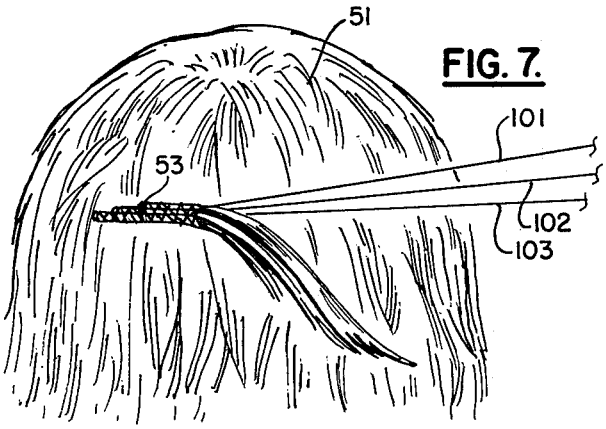

At this point an additional, adjacent shank of hair is picked up at a point to the side adjacent to where the previous weave has ended in the direction that the woven band is desired to go (from left-to-right when view from the perspective of FIG. 7). After the additional shank of hair is applied to the original shank 52, the above double sequential steps are repeated, that is six inter-weaves are again made by sequentially applying the three threads 101–103 in double sequence to produce a longer interwoven braid.

With then another additional shank of hair, the above procedure is again repeated until the operator 50 has traversed the entire band 53 which was desired to be woven on the subject's head 51. At the end of the final shank of hair a square knot is tied and the threads 101–103 severed, all of which completes the weaving of that band of hair and secures the end of the band directly on the scalp. Additional bands can then be woven as desired by following the same procedure outlined above for the initial band 53.

The woven or braided hair band(s) is then used as a base for hand sewing on additional hair desired to be added as hair wefting for a complete hair weave.

It should be appreciated that doing all of the weaving steps, the thread supply tension device supplies the threads 101–103 under tension, that is with even, controlled resistance to the constantly applied tension or pressure produced by the operator 50.

Moreover, as is clear from the foregoing, the thread supply tension device 3 including the support post 2 is immobile during use with the threads 101, 102, 103 being supplied under tension by rotation of the spools 11 as the operator pulls on the threads.

Exemplary Variations

The aforedescribed preferred embodiment has been tested in use and been found to be quite satisfactory in operation and results. However, like all mechanical devices, great variation is possible in both structural detail and application. For example the connection between the upper and lower sections 2, 3 could be made square to allow for four different orientations rather than just two, or indeed the sections could be allowed to rotate with respect to one another, allowing infinite and immediate variation in orientation. Likewise, rather than a C type clamp, other mounting means could be used or indeed the support post 2 could be integrally attached to its own table or chest and provided as a combined unit. Moreover, although the particular tension system illustrated and described as been found to be particularly efficacious, other controlled tension or resistance means could be employed, for example a spring biased axis mount for the spool could be used. Additionally, rather than use three separate tension applying members, the spools of thread could be ganged on a common axis and one tension applying member used. The foregoing are of course merely exemplary variations and certainly are not exhaustive of the possibilities.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed as invention is:

1. A hair weaving tension system for weaving hair wherein said system includes a source of a multiple number of threads, said source comprising:

a support member which is immobile during use:

thread supply means, each including a rotatable spool with thread thereon, mounted on said support member; and tension applying means also mounted on said support member for applying controlled resistance to the threads coming from said thread supply means when they are pulled by an operator, rotating the spools, in using the threads to weave hair, allowing the operator to secure the threads while weaving under controlled resistance without having to move the position of the thread supply means.

2. The hair weaving tension system of claim 1 wherein there is further included:

tension varying means connected to said tension applying means for varying the amount of resistance applied by said tension applying means.

3. The hair weaving tension system of claim 1 wherein there is further included:

mounting means connected to said support member for mounting said support member in an immobile position to a suitable working surface.

4. The hair weaving tension system of claim 2 wherein:

there are three threads used in the weaving process;

said support member comprises a vertical post;

said multiple thread supply means comprises three separate spools of thread; and said tension applying means and said tension varying means comprise three separate cylindrical housings, one for each of said spools, each said cylindrical housing including resilient bearing means connected to said housing for bearing against the outer surface of said housing, and force varying means for varying the amount of force said bearing means bears against said housing, the thread from each spool being passed between the area said bearing means bears against said housing, whereby frictional drag resistance is applied to the thread.

5. The hair weaving tension system of claim 4 wherein:

said bearing means is likewise cylindrically shaped with substantially the same radius of curvature as the cylindrical housing so that the two mate together in substantial area face-to-face engagement; and said varying means is a screw connected between said resilient bearing means and said housing, the position of said screw determining the amount of bearing force between said bearing means and said housing.

6. The method of weaving hair comprising the following steps:

a. providing a thread supply tension device supplying threads to be used in weaving the hair comprising: a support member which is immobile during use; thread supply means, each including a rotatable spool with thread thereon, mounted on said support member; and tension applying means also mounted on said support member for applying controlled resistance to the threads coming from said thread supply means when they are pulled by an operator, rotating the spoools, in using the threads to weave hair;

b. setting the tension applying means to apply an appropriate resisting tension on the threads;

c. pulling the threads, thereby rotating the spools of threads, and tying them to the hair and weaving the hair to produce bands of woven hair, while said thread supply tension device is applying controlled resistance to the movement of the threads; whereby said device produces a controlled and even flow of thread and allows the operator to secure the threads while weaving under controlled resistance without having to move the position of the thread supply means.

7. The hair weaving tension system of claim 3 wherein said mounting means is a C clamp.

8. The method of claim 6 wherein in step a there is further provided mounting means connected to said support member for mounting said support member in an immobile position to a suitable working surface, said support member being immobily mounted by said mounting means prior to and during step c.

9. The method of claim 8 wherein said mounting means is a C clamp and said support means is mounted on the work surface by screwing said C clamp tight.

* * * * *